US008909125B2

(12) United States Patent
Kinoshita et al.

(10) Patent No.: US 8,909,125 B2
(45) Date of Patent: Dec. 9, 2014

(54) IMAGE FORMING APPARATUS

(71) Applicant: Panasonic Corporation, Osaka (JP)

(72) Inventors: Hironobu Kinoshita, Fukuoka (JP); Masaya Shitami, Fukuoka (JP); Kazunori Matsuo, Fukuoka (JP)

(73) Assignee: Panasonic Corporation, Osaka (JP)

( * ) Notice: Subject to any disclaimer, the term of this patent is extended or adjusted under 35 U.S.C. 154(b) by 0 days.

(21) Appl. No.: 14/190,993

(22) Filed: Feb. 26, 2014

(65) Prior Publication Data

US 2014/0255072 A1 Sep. 11, 2014

(30) Foreign Application Priority Data

Mar. 6, 2013 (JP) ..... 2013-044460

(51) Int. Cl.

| | |
|---|---|
| ***G03G 15/00*** | (2006.01) |
| ***B65H 5/26*** | (2006.01) |
| ***B65H 5/06*** | (2006.01) |
| ***G03G 13/22*** | (2006.01) |
| ***G03G 15/23*** | (2006.01) |

(52) U.S. Cl.

CPC ..... *B65H 5/26* (2013.01); *B65H 5/062* (2013.01); *G03G 13/22* (2013.01); *G03G 15/234* (2013.01); *G03G 15/6579* (2013.01); *G03G 2215/00438* (2013.01)

USPC ..... 399/401

(58) Field of Classification Search

CPC ..... G03G 15/00

USPC ..... 399/364, 401

See application file for complete search history.

(56) References Cited

U.S. PATENT DOCUMENTS

| | | | | |
|---|---|---|---|---|
| 6,078,760 | A | 6/2000 | Abe et al. | |
| 6,185,380 | B1 * | 2/2001 | Abe et al. | 399/18 |
| 6,983,122 | B2 * | 1/2006 | Hayamizu et al. | 399/405 |
| 7,176,952 | B2 * | 2/2007 | Ishida et al. | 347/156 |
| 2005/0254871 | A1 * | 11/2005 | Kim | 399/401 |
| 2006/0291874 | A1 * | 12/2006 | Kyung | 399/16 |
| 2007/0077104 | A1 * | 4/2007 | Hasegawa | 399/328 |
| 2008/0181696 | A1 * | 7/2008 | Lee et al. | 399/364 |
| 2010/0034559 | A1 * | 2/2010 | Sahara | 399/122 |
| 2011/0103809 | A1 * | 5/2011 | Kuwata et al. | 399/16 |
| 2013/0071166 | A1 * | 3/2013 | Mori | 399/364 |
| 2013/0236226 | A1 * | 9/2013 | Funayama | 399/364 |

FOREIGN PATENT DOCUMENTS

| | | | |
|---|---|---|---|
| JP | 11-035210 | A | 2/1999 |
| JP | 2000-026002 | A | 1/2000 |
| JP | 2001-063892 | A | 3/2001 |
| JP | 2001-117291 | A | 4/2001 |

(Continued)

*Primary Examiner* — Nguyen Ha

(74) *Attorney, Agent, or Firm* — Seed IP Law Group PLLC

(57) ABSTRACT

Disclosed is an image forming apparatus including: an ejection section including an ejection roller to eject a sheet from a first sheet passing path to a sheet ejection port and a reverse roller to reverse a transport direction of a sheet transported along a second sheet passing path, the ejection roller and the reverse roller being placed close to each other and close to the sheet ejection port; and a switching lever switches the transport destination of the sheet between the first and the second sheet passing paths for transporting the sheet to the ejection roller and to the reverse roller, respectively. A moving trajectory of a sheet transported along the first sheet passing path between the ejection roller and the switching lever is substantially identical to a moving trajectory of a sheet transported along the second sheet passing path between the reverse roller and the switching lever.

17 Claims, 3 Drawing Sheets

(56) References Cited

FOREIGN PATENT DOCUMENTS

| | | | | | |
|---|---|---|---|---|---|
| JP | 2001183875 | A | * | 7/2001 | B65H 85/00 |
| JP | 2001335216 | A | * | 12/2001 | G03G 15/00 |
| JP | 2003327364 | A | * | 11/2003 | G03G 15/00 |
| JP | 2004035132 | A | * | 2/2004 | B65H 31/30 |
| JP | 2004085624 | A | * | 3/2004 | G03G 15/00 |
| JP | 2010286525 | A | * | 12/2010 | G03G 15/20 |
| JP | 2013010601 | A | * | 1/2013 | G03G 15/00 |

* cited by examiner

IMAGE FORMING APPARATUS

BACKGROUND OF THE INVENTION

1. Field of the Invention

The present invention relates to an image forming apparatus including a double-sided printing function.

2. Description of the Related Art

In recent years, image forming apparatuses such as a multifunction printer (MFP) including functions of a printer, a copying machine, FAX, and the like have been in widespread use. The image forming apparatuses generally include almost all functions necessary to complete office work, are compact, do not take up too much space, and are also excellent in terms of costs. Thus, the widespread use of these image forming apparatuses is expected to increase.

In addition, some image forming apparatuses include the double-sided printing function which forms an image on one side of a printing sheet and thereafter forms an image on the reverse side of the printing sheet (for example, see PTL 1). In the double-sided printing, an image is also formed on the reverse side by forming an image on one side of the printing sheet in an image forming section and then feeding and reversing the sheet through a double-sided sheet passing path to feed the sheet again into the image forming section.

CITATION LIST

Patent Literature

PTL 1

Japanese Patent Application Laid-Open No. 2001-63892

Along with a reduction in size and increase in printing speed of such an image forming apparatus, processing for forming, using a sheet including one side with an image formed, an image on the other side of the sheet (switchback processing) and processing for ejecting a sheet with images formed on both sides (or a sheet during single-sided printing) are expected to be performed, simultaneously.

In this case, in an image forming apparatus in which an ejection roller configured to perform ejection and a switchback roller (reverse roller) configured to perform switchback are provided close to each other, there is a case where a sheet which is ejected from a sheet passing path for ejection by the ejection roller and a sheet which is ejected from a double-sided sheet passing path to a sheet ejection port once by the reverse roller and pulled into the double-sided sheet passing path again by switchback processing are present in the sheet ejection port at the same time. In this case, the sheets are likely to come into contact with each other (interfere with each other). If the sheets come into contact with each other, the sheets are bent to cause a paper jam, and/or the images formed on the sheets are smudged. PTL 1 discloses providing an interference prevention guide between the rollers to which each of the sheets is ejected in the sheet ejection port, in order to prevent the sheets from coming into contact with each other. However, providing such an interference prevention guide makes it difficult to achieve a reduction in size of the image forming apparatus.

SUMMARY OF THE INVENTION

The present invention has been made in consideration of the above-described situation, and an object of the invention is to provide an image forming apparatus capable of preventing sheets transported along a sheet passing path for ejection and a double-sided sheet passing path, respectively, from coming into contact with each other in a sheet ejection port without causing an increase in size of the apparatus.

An image forming apparatus according to an aspect of the present invention is an image forming apparatus that reverses a recording medium with an image formed on one side of the recording medium by an image forming section provided in a first sheet passing path, that returns the recording medium to the first sheet passing path, and that forms an image on another side of the recording medium, the recording medium being reversed in a second sheet passing path, the apparatus including no guide for the recording medium on a downstream side from a sheet ejection port in a direction in which the recoding medium is ejected, the apparatus including: an ejection section that includes: an ejection roller that is placed close to the sheet ejection port and that ejects the recording medium from the first sheet passing path to the sheet ejection port; and a reverse roller that is placed close to the sheet ejection port and that reverses a transport direction of the recording medium transported along the second sheet passing path, the ejection roller and the reverse roller being placed close to each other; and a switching lever that is placed at a position following the image forming section and that is configured to switch a transport destination of the recording medium between the first sheet passing path for transporting the recording medium to the ejection roller and the second sheet passing path for transporting the recording medium to the reverse roller, in which: the switching lever is placed at a position such that the first sheet passing path from the switching lever to the ejection roller curves and the second sheet passing path from the switching lever to the reverse roller curves; the ejection section simultaneously performs processing for ejecting a first recording medium to the sheet ejection port by the ejection roller and processing for reversing a transport direction of a second recording medium by the reverse roller and returning the second recording medium to the first sheet passing path; and the first sheet passing path and the second sheet passing path are formed such that a moving trajectory of the first recording medium transported along the first sheet passing path between the ejection roller and the switching lever is identical to a moving trajectory of the second recording medium transported along the second sheet passing path between the reverse roller and the switching lever.

According to the invention, it is possible to prevent sheets transported along the sheet passing path for ejection and the double-sided sheet passing path, respectively, from coming into contact with each other in a sheet ejection port without causing an increase in size of the apparatus.

DESCRIPTION OF THE EMBODIMENTS

Hereinafter, an embodiment of the present invention will be described in detail with reference to the drawings.

[Configuration of Image Forming Apparatus]

Figure 1:
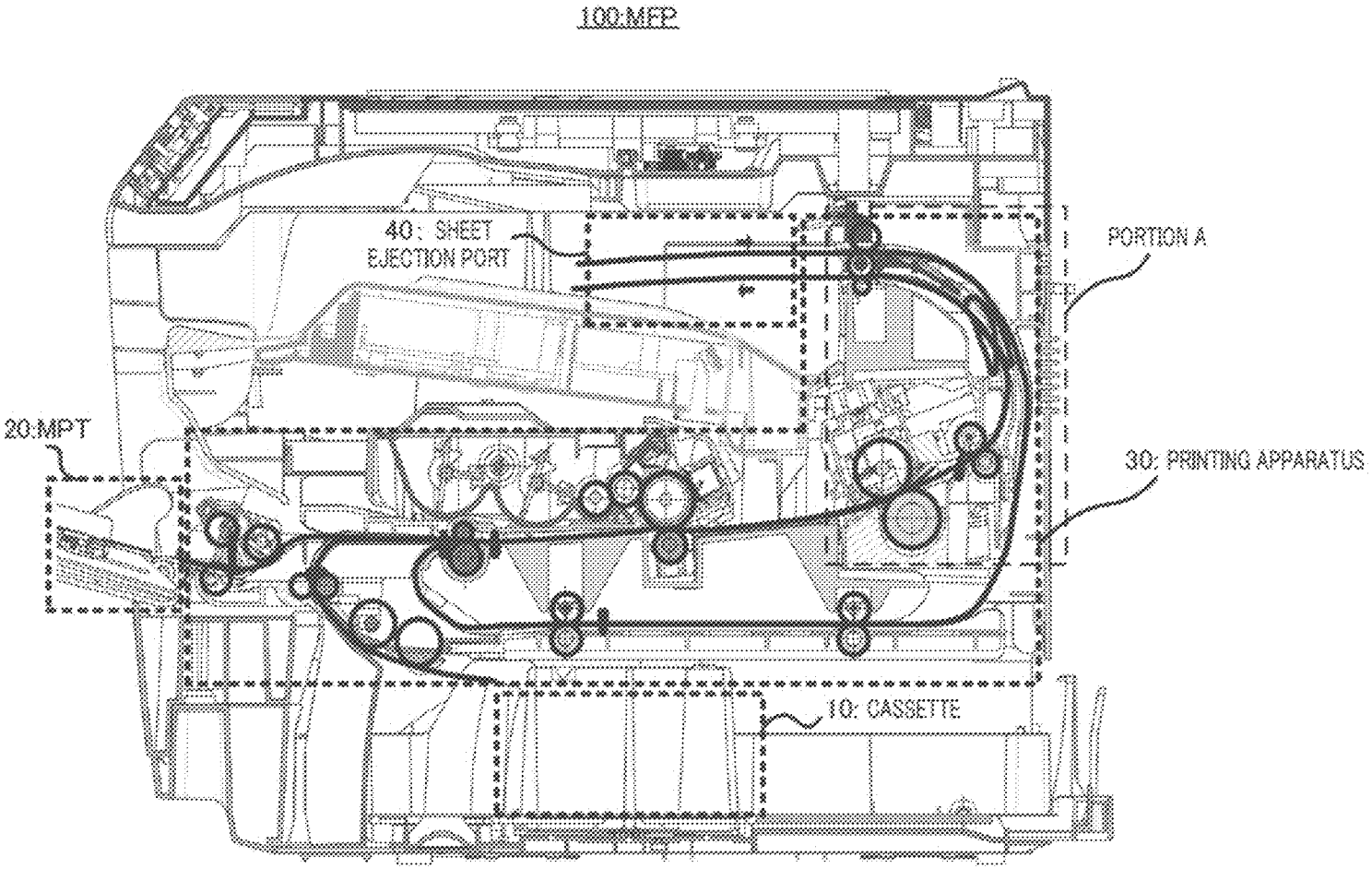
FIG. 1 is a sectional view showing the configuration of an image forming apparatus according to an embodiment of the invention.

FIG. 1 is a sectional view showing the configuration of image forming apparatus (MFP) 100.

Image forming apparatus 100 takes out a recording medium (hereinafter referred to as "sheet") housed in cassette (sheet-feeding tray) 10 or multi-purpose tray (MPT) (manual sheet-feeding tray) 20, delivers the recording medium to printing apparatus 30, prints image data on the sheet in printing apparatus 30, and ejects the sheet on which the image data is printed to sheet ejection port 40.

[Configuration of Printing Apparatus 30]

Figure 2:
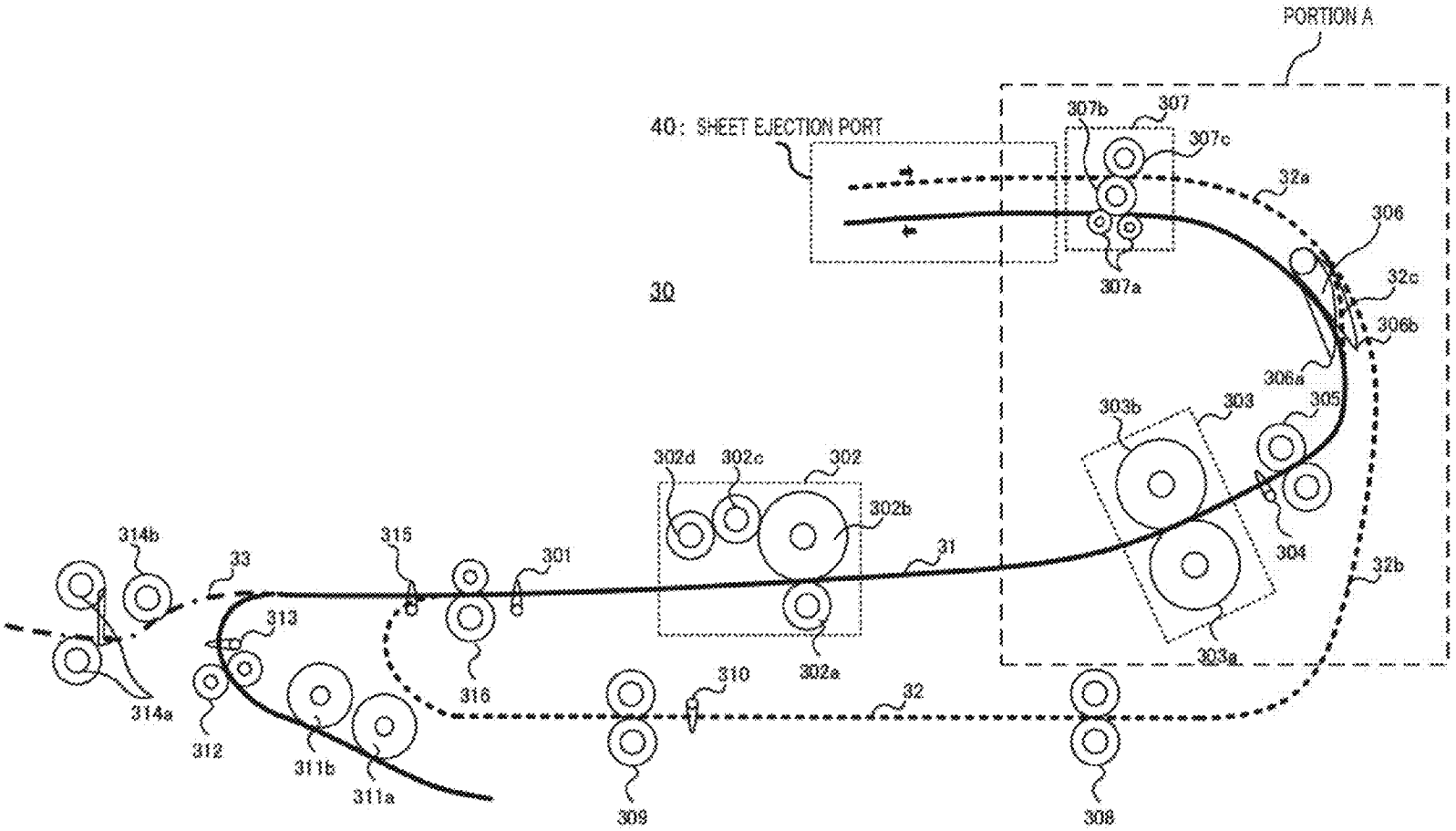
FIG. 2 is a diagram showing the configuration of a printing apparatus in the embodiment of the invention.

FIG. 2 is a conceptual diagram of printing apparatus 30 in FIG. 1. Printing apparatus 30 includes a double-sided printing function which forms an image on one side of a sheet (recording medium) and thereafter forms an image on the other side of the sheet.

Printing apparatus 30 shown in FIG. 2 has single-sided sheet passing path 31 (solid line), double-sided sheet passing path 32 (broken line), and MPT sheet passing path 33 (one-dot-chain line) as a sheet passing path along which the sheet is transported.

Single-sided sheet passing path 31 is a transporting path along which the sheet is transported during single-sided printing or double-sided printing, and is a transporting path along which sheet feeding, image formation, fixation, and sheet ejection are performed.

Double-sided sheet passing path 32 is a sheet passing path along which the sheet is transported during double-sided printing. Double-sided sheet passing path 32 includes sheet passing path 32*a* for reversing (switchback) sheet, sheet passing path 32*b* for allowing the reversed sheet to join single-sided sheet passing path 31 again, and sheet passing path 32*c* for feeding the sheet into sheet passing path 32*a* from single-sided sheet passing path 31.

MPT sheet passing path 33 is a transporting path along which the sheet is transported from MPT 20 to single-sided sheet passing path 31.

Top sensor 301 detects whether or not a sheet is passing over top sensor 301. Specifically, top sensor 301 generates an OFF signal when no sheet is passing over top sensor 301 and generates an ON signal when a sheet is passing over top sensor 301.

Image forming section 302 includes transfer roller 302*a*, OPC (Organic Photo Conductor) 302*b*, developing roller 302*c*, and supply roller 302*d*. Image forming section 302 transfers a toner image according to image data to the transported sheet, thereby forming an image on the sheet.

Fixing section 303 includes pressing roller 303*a* and heating roller 303*b*. Fixing section 303 fixes the toner image transferred to the sheet.

Sheet ejection sensor 304 detects whether or not a sheet is passing over sheet ejection sensor 304. Specifically, similarly to top sensor 301, sheet ejection sensor 304 generates an OFF signal when no sheet is passing over sheet ejection sensor 304 and generates an ON signal when a sheet is passing over sheet ejection sensor 304.

Sheet ejection roller 305 is placed at a position following fixing section 303 and transports the transported sheet in the direction of switching lever 306.

Switching lever 306 is a switching lever configured to turn around an axis and including a guide extending from the axis toward image forming section 302 and switches the transport destination of the sheet transported by sheet ejection roller 305 to any one of single-sided sheet passing path 31 and double-sided sheet passing path 32. In a state where switching lever 306 is at position 306*a*, the sheet is transported in the direction of ejection section 307 on double-sided sheet passing path 32*c*. On the other hand, in a state where switching lever 306 is at position 306*b*, the sheet is transported in the direction of ejection section 307 on single-sided sheet passing path 31.

Ejection section 307 includes rollers 307*a*, 307*b*, and 307*c* placed in proximity to sheet ejection port 40. Rollers 307*a* and roller 307*b* constitute an ejection roller that ejects a sheet transported on single-sided sheet passing path 31 to sheet ejection port 40. Additionally, roller 307*b* and roller 307*c* constitute a reverse roller (switchback roller) that reverses the transport direction of the sheet transported on double-sided sheet passing path 32 (sheet passing path 32*a*). That is, roller 307*b*, which is a roller in a set of ejection rollers, is shared as a roller in a set of reverse rollers. Furthermore, the ejection rollers and the reverse rollers include three rollers 307*a*, 307*b*, and 307*c*, and the reverse rollers are placed above the ejection rollers.

In the following description, the rotation processing of rollers 307*a*, 307*b*, and 307*c* when the sheet transported on single-sided sheet passing path 31 is ejected to sheet ejection port 40 is referred to as "forward rotation processing," and rotation processing reverse to "forward rotation processing" is referred to as "reverse rotation processing." That is, in the forward rotation processing, a sheet on single-sided sheet passing path 31 is transported by roller 307*a* and roller 307*b* in the direction in which the sheet is ejected to sheet ejection port 40, and a sheet on sheet passing path 32*a* is transported by roller 307*b* and roller 307*c* in the direction of sheet passing path 32*b*. On the other hand, in the reverse rotation processing, sheet on sheet passing path 32*a* is transported by roller 307*b* and roller 307*c* in the direction in which the sheet is ejected to sheet ejection port 40.

That is, during the double-sided printing, first, ejection section 307 pulls the sheet transported on sheet passing path 32*c* to sheet passing path 32*a* by the reverse rotation processing of the reverse rollers (rollers 307*b* and 307*c*). Next, ejection section 307 transports the sheet on sheet passing path 32*a* in the direction of sheet passing path 32*b* by the forward rotation processing of the reverse rollers.

ADU (Automatic Duplex Unit) transport roller 308 and ADU transport roller 309 transport the sheet transported from ejection section 307 to sheet passing path 32*b* in the direction of single-sided sheet passing path 31. Since the two sides of the sheet that has joined single-sided sheet passing path 31 from sheet passing path 32*b* have been reversed, the double-sided printing is enabled in printing apparatus 30. ADU sensor 310 detects whether or not a sheet has passed over ADU sensor 310, thereby detecting that the sheet is being transported along sheet passing path 32*b*.

Pick roller 311*a* and separation roller 311*b* take out sheets one by one from cassette 10, and feed roller 312 delivers the taken-out sheet to single-sided sheet passing path 31. Pickup sensor 313 detects whether or not the sheet has passed over pickup sensor 313, thereby detecting that the sheet is taken out from cassette 10.

MPT pick roller 314*a* and MPT transport roller 314*b* take out sheets one by one from MPT 20, and delivers the taken-out sheet from MPT sheet passing path 33 to single-sided sheet passing path 31.

Registration sensor 315 detects whether or not a sheet has passed over registration sensor 315. Registration roller 316 corrects the leading end position of the sheet to be transported on the basis of a position detected by registration sensor 315. This allows an image to be printed and a fed sheet to be synchronized with each other.

[Configuration Near Switching Lever 306 and Ejection Section 307]

Figure 3B:
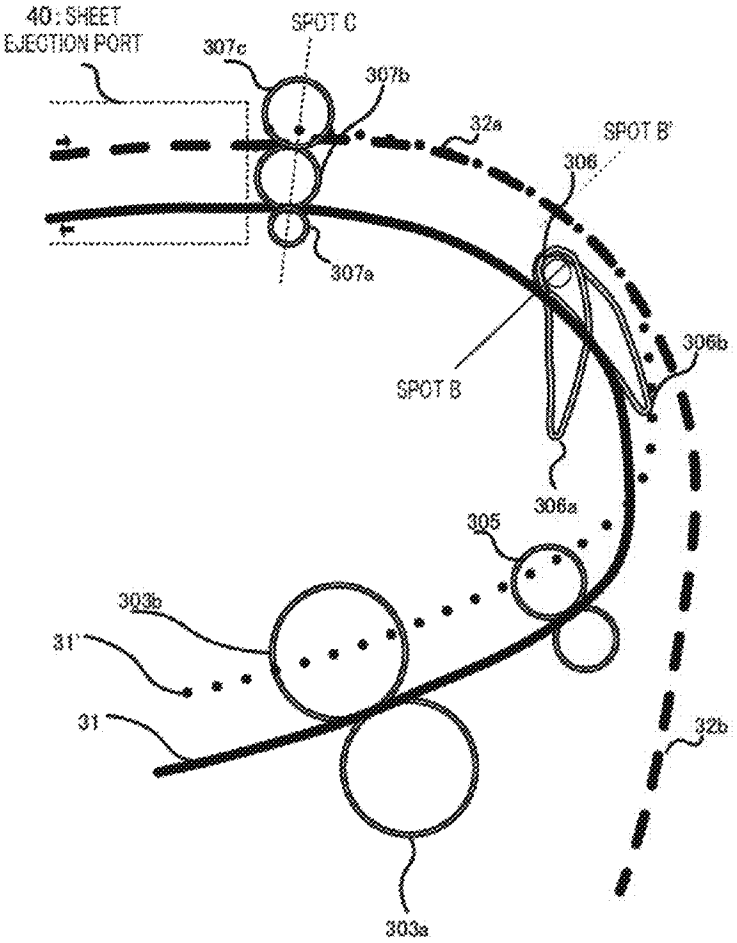
FIGS. 3A and 3B are an enlarged view of an image forming apparatus according to an embodiment of the invention and a diagram showing a moving trajectory of a sheet.
Figure 3A:
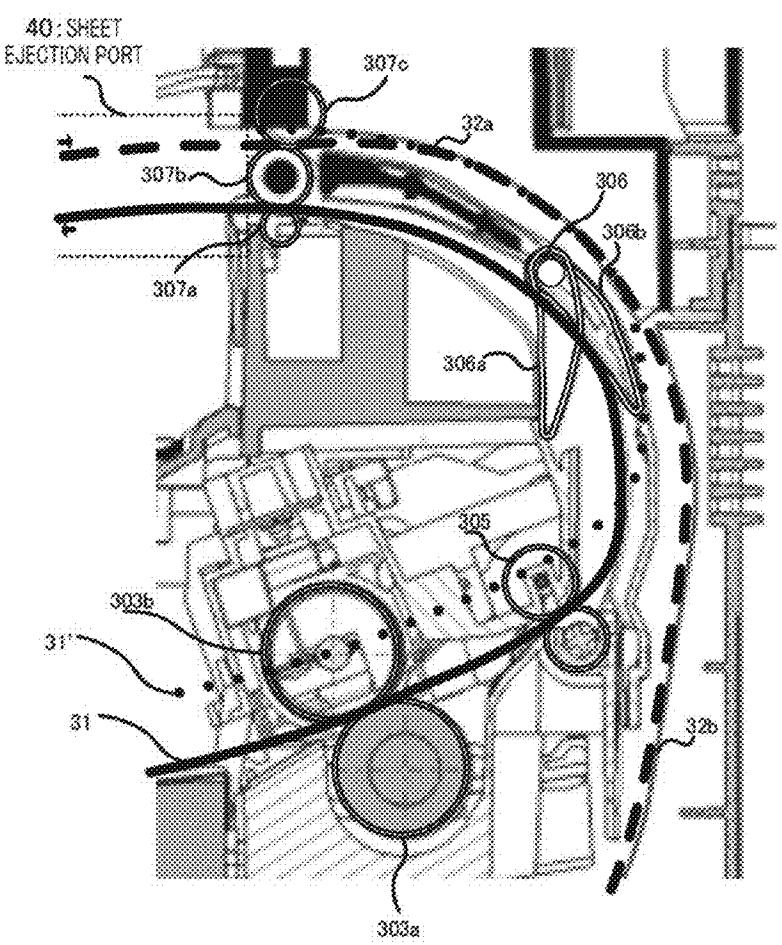

FIG. 3A is an enlarged view near switching lever 306 and ejection section 307 (portion A shown in FIG. 1 and FIG. 2). FIG. 3B shows a moving trajectory of a sheet to be transported in FIG. 3A.

In this embodiment, single-sided sheet passing path 31 and sheet passing path 32*a* are formed such that a moving trajectory of a sheet to be transported along single-sided sheet passing path 31 between the ejection rollers (ejection section 307) and switching lever 306 substantially becomes the same as a moving trajectory of a sheet to be transported along sheet passing path 32*a* between the reverse rollers (ejection section 307) and switching lever 306.

That is, single-sided sheet passing path 31 and sheet passing path 32*a* (double-sided sheet passing path) substantially have the same shape between switching lever 306 (the axis of switching lever 306) and ejection section 307 shown in FIG. 3A. In this way, the moving trajectory (solid line) of a sheet to be transported along single-sided sheet passing path 31 substantially becomes the same as the moving trajectory (broken line) of a sheet to be transported along sheet passing path 32*a* (double-sided sheet passing path) between the axis of switching lever 306 and ejection section 307 shown in FIG. 3B.

Here, trajectory 31' (dotted line) shown in FIG. 3A and FIG. 3B represents the moving trajectory of a sheet to be transported along single-sided sheet passing path 31 when the moving trajectory (solid line) between point B and point C of single-sided sheet passing path 31 is superimposed on the moving trajectory (broken line) of sheet passing path 32*a* with point C as a reference.

For example, point B is the position of the axis of switching lever 306, and point C represents a position at which the sheet passes through the respective rollers of ejection section 307. Point B' represents a position in trajectory 31' corresponding to point B of single-sided sheet passing path 31.

As shown in FIG. 3B, trajectory 31' (corresponding to the moving trajectory between point B and point C of single-sided sheet passing path 31) between point B' and point C substantially matches the moving trajectory of a sheet in sheet passing path 32*a*.

In this way, a sheet to be transported along single-sided sheet passing path 31 in the direction of sheet ejection port 40 and a sheet to be transported along sheet passing path 32*a* in the direction of sheet ejection port 40 pass through the sheet passing paths having the same shape, that is, the sheets are transported to draw the same moving trajectory. For this reason, the sheet to be transported along single-sided sheet passing path 31 and the sheet to be transported along sheet passing path 32*a* have a similar bending tendency.

As shown in FIG. 3A, a sheet with an image formed on one side during the double-sided printing is transported on sheet passing path 32*a* in the direction in which the sheet is ejected to ejection port 40, by the reverse rotation processing of the reverse rollers (rollers 307*b* and 307*c*), and is thereafter transported on sheet passing path 32*a* in the direction in which the sheet is ejected to sheet passing path 32*b*, by the forward rotation processing of the reverse rollers. During the double-sided printing, a sheet with images formed on both sides (or a sheet during the single-sided printing) is transported on single-sided sheet passing path 31 in the direction in which the sheet is ejected to sheet ejection port 40, by the forward rotation processing of the sheet ejection rollers (rollers 307*a* and 307*b*).

That is, there is a case where the ejection processing and the switchback processing are performed simultaneously by the forward rotation processing of respective rollers 307*a*, 307*b*, and 307*c* of ejection section 307. During this processing, in sheet ejection port 40, a sheet is ejected to sheet ejection port 40 on single-sided sheet passing path 31 by the ejection rollers, and a sheet ejected to sheet ejection port 40 once by the reverse rollers is returned in the direction of sheet passing path 32*b* on sheet passing path 32*a*. That is, in sheet ejection port 40 shown in FIG. 3A and FIG. 3B, the sheet ejected from single-sided sheet passing path 31 and the sheet reversed (switchback) and returned to sheet passing path 32*a* are present at the same time.

However, as described above, as shown in FIG. 3A and FIG. 3B, the sheet to be transported on sheet passing path 32*a* in the direction in which the sheet is ejected to sheet ejection port 40, by the reverse rotation processing of the reverse rollers immediately before the above-described processing and the sheet to be transported on single-sided sheet passing path 31 in the direction in which the sheet is ejected to sheet ejection port 40, by the forward rotation processing of the ejection rollers of the above-described processing draw the same moving trajectory in the sheet passing path immediately before ejection section 307 (ejection rollers and reverse rollers). Accordingly, both sheets have the same bending tendency.

Accordingly, as shown in FIG. 3A and FIG. 3B, the sheet to be transported on single-sided sheet passing path 31 in the direction in which the sheet is ejected to sheet ejection port 40, and the sheet to be transported on sheet passing path 32*a* in the direction in which the sheet is ejected to sheet passing path 32*b*, draw substantially parallel moving trajectories in sheet ejection port 40 without interfering with each other. In this way, the sheets to be transported along respective sheet passing paths of adjacent single-sided sheet passing path 31 and sheet passing path 32*a* substantially have the same bending tendency, whereby there is a lower possibility that the sheets to be transported along single-sided sheet passing path 31 and sheet passing path 32*a* come into contact with each other in sheet ejection port 40.

As described above, in ejection section 307, even when processing for reversing a sheet with an image on one side and processing for ejecting a sheet with images formed on both sides (or a sheet during the single-sided printing) are performed simultaneously, it is possible to prevent the sheets passing through the respective sheet passing paths from coming into contact with each other in sheet ejection port 40. The sheets passing through the respective sheet passing paths are prevented from coming into contact with each other, which makes it possible to prevent the occurrence of paper jam caused by the sheets being bent, and also to prevent the images formed on the sheets from coming into contact with each other and thus smudged.

In this embodiment, the sheets to be ejected to sheet ejection port 40 can have the same bending tendency in both single-sided sheet passing path 31 and sheet passing path 32*a* (double-sided sheet passing path). Thus, the moving trajectories of the respective sheets in sheet ejection port 40 are substantially parallel to each other, so that it is possible to prevent the sheets from coming into contact with each other. Thus, according to this embodiment, unlike the related art, since it is not necessary to additionally provide an interference prevention guide in the sheet ejection port in order to prevent the sheets from coming into contact with each other, it is possible to achieve a reduction in size of image forming apparatus 100.

Thus, according to this embodiment, it is possible to prevent the sheets transported along the sheet passing path for ejection and the double-sided sheet passing path from coming into contact with each other in the sheet ejection port without causing an increase in size of the apparatus.

In the foregoing embodiment, although a case where a sheet is used as a recording medium has been described, the recording medium is not limited to a sheet, and any recording medium may be used insofar as the double-sided printing is possible.

The present invention is useful for an image forming apparatus which can perform double-sided printing.

INCORPORATION BY REFERENCE

The present application claims priority from Japanese application JP 2013-044460 filed on Mar. 6, 2013, the content of which is hereby incorporated by reference into this application.

The invention claimed is:

1. An image forming apparatus that reverses a recording medium having double sides, on one side of which an image is formed by an image forming section provided in a first sheet passing path, the recording medium being reversed in a second sheet passing path and returned in a reversed state to the first sheet passing path, the apparatus further being configured to form an image on another side of the recording medium in the first sheet passing path, and to eject the recording medium having the images formed on both sides to a sheet ejection port, the apparatus including no guide for the recording medium in the sheet ejection port, the apparatus comprising:

an ejection section that includes:

an ejection roller that is placed close to the sheet ejection port and that ejects the recording medium from the first sheet passing path to the sheet ejection port; and a reverse roller that is placed close to the sheet ejection port and that switches a transport direction of the recording medium transported along the second sheet passing path, the ejection roller and the reverse roller being placed close to each other; and a switching lever that is placed at a position downstream of the image forming section, that turns around an axis, and that is configured to switch a transport destination of the recording medium between the first sheet passing path for transporting the recording medium to the ejection roller and the second sheet passing path for transporting the recording medium to the reverse roller, wherein:

the switching lever is placed at a position such that the first sheet passing path from the switching lever to the ejection roller curves and the second sheet passing path from the switching lever to the reverse roller curves;

the ejection section simultaneously performs processing for ejecting a first recording medium to the sheet ejection port by the ejection roller and processing for switching a transport direction of a second recording medium in the sheet ejection port by the reverse roller and returning the second recording medium to the first sheet passing path; and the first sheet passing path and the second sheet passing path are formed such that a curving shape of a first moving trajectory of the first recording medium from the switching lever to the ejection roller along the first sheet passing path is identical to a curving shape of a second moving trajectory of the second recording medium from the switching lever to the reverse roller along the second sheet passing path, wherein a highest portion of the ejection roller is located above a level of the axis of the switching lever.

2. The image forming apparatus according to claim 1, wherein the ejection roller and the reverse roller are formed of three rollers.

3. The image forming apparatus according to claim 2, wherein the reverse roller is placed at a position higher than the ejection roller in the image forming apparatus in upright orientation.

4. The image forming apparatus according to claim 1, wherein the image forming section includes:

a transfer roller;

an organic photo conductor; and a developing roller, wherein the image forming section transfers a toner image according to image data to a transported recording medium to form an image on the recording medium.

5. The image forming apparatus according to claim 1, further comprising a fixing section that is provided between the image forming section and the switching lever and that fixes a toner image transferred to the recording medium.

6. The image forming apparatus according to claim 5, further comprising a transport roller placed between the fixing section and the switching lever, wherein the first and second moving trajectories are longer than a moving trajectory of the first recording medium from the fixing section to the transport roller along the first sheet passing path.

7. The image forming apparatus according to claim 1, wherein the first and second moving trajectories having the identical curving shape are sufficiently long to effect the first recording medium transported along the first sheet passing path and the second recording medium transported along the second sheet passing path to have a similar bending tendency to follow substantially parallel trajectories in the sheet ejection port.

8. An image forming apparatus that reverses a recording medium having double sides, on one side of which an image is formed by an image forming section provided in a first sheet passing path, the recording medium being reversed in a second sheet passing path and returned in a reversed state to the first sheet passing path, the apparatus further being configured to form an image on another side of the recording medium in the first sheet passing path, and to eject the recording medium having the images formed on both sides to a sheet ejection port, the apparatus including no guide for the recording medium in the sheet ejection port, the apparatus comprising:

an ejection section that includes:

an ejection roller that is placed close to the sheet ejection port and that ejects the recording medium from the first sheet passing path to the sheet ejection port; and a reverse roller that is placed close to the sheet ejection port and that switches a transport direction of the recording medium transported along the second sheet passing path, the ejection roller and the reverse roller being placed close to each other; and a switching lever that is placed at a position downstream of the image forming section, that turns around an axis, that includes a guide extending from the axis toward the image forming section, and that is configured to switch a transport destination of the recording medium between the first sheet passing path for transporting the recording medium to the ejection roller and the second sheet passing path for transporting the recording medium to the reverse roller, wherein:

the switching lever is placed at a position such that the first sheet passing path from the axis of the switching lever to the ejection roller curves and the second sheet passing path from the axis of the switching lever to the reverse roller curves;

the ejection section simultaneously performs processing for ejecting a first recording medium to the sheet ejection port by the ejection roller and processing for switching a transport direction of a second recording medium in the sheet ejection port by the reverse roller and returning the second recording medium to the first sheet passing path; and the first sheet passing path and the second sheet passing path are formed such that a curving shape of a first moving trajectory of the first recording medium from the axis of the switching lever to the ejection roller along the first sheet passing path is identical to a curving shape of a second moving trajectory of the second recording medium from the axis of the switching lever to the reverse roller along the second sheet passing path, wherein a highest portion of the ejection roller is located above a level of the axis of the switching lever.

9. The image forming apparatus according to claim 8, wherein the ejection roller and the reverse roller are formed of three rollers.

10. The image forming apparatus according to claim 9, wherein the reverse roller is placed at a position higher than the ejection roller in the image forming apparatus in upright orientation.

11. The image forming apparatus according to claim 8, wherein the image forming section includes:

a transfer roller;

an organic photo conductor; and a developing roller, wherein the image forming section transfers a toner image according to image data to a transported recording medium to form an image on the recording medium.

12. The image forming apparatus according to claim 8, further comprising a fixing section that is provided between the image forming section and the switching lever and that fixes a toner image transferred to the recording medium.

13. The image forming apparatus according to claim 12, further comprising a transport roller placed between the fixing section and the switching lever, wherein the first and second moving trajectories are longer than a moving trajectory of the first recording medium from the fixing section to the transport roller along the first sheet passing path.

14. The image forming apparatus according to claim 8, wherein the first and second moving trajectories having the identical curving shape are sufficiently long to effect the first recording medium transported along the first sheet passing path and the second recording medium transported along the second sheet passing path to have a similar bending tendency to follow substantially parallel trajectories in the sheet ejection port.

15. An image forming apparatus including a double-sided printing function that reverses a recording medium, which is taken out and transported from a sheet-feeding tray or a multi-purpose tray and on one side of which an image is formed by an image forming section provided in a first sheet passing path, the recording medium being reversed in a second sheet passing path that joins the first sheet passing path and returned in a reversed state to the first sheet passing path again, the apparatus further being configured to form an image on another side of the recording medium in the first sheet passing path, and to eject the recording medium having the images formed on both sides to a sheet ejection port, the apparatus including no guide for the recording medium in the sheet ejection port, the apparatus comprising:

an ejection section that includes:

a pair of ejection rollers that are placed close to the sheet ejection port and that eject the recording medium from the first sheet passing path to the sheet ejection port; and a pair of reverse rollers that are placed close to the sheet ejection port and that switch a transport direction of the recording medium transported along the second sheet passing path, the ejection rollers and the reverse rollers being placed close to each other, and one of the pair of ejection rollers being commonly used as one of the pair of reverse rollers; and a switching lever that is placed at a position downstream of the image forming section, that turns around an axis, that includes a guide extending from the axis toward the image forming section, and that is configured to switch a transport destination of the recording medium between the first sheet passing path for transporting the recording medium to the ejection rollers and the second sheet passing path for transporting the recording medium to the reverse rollers, wherein:

the switching lever is placed at a position such that the first sheet passing path from the axis of the switching lever to the ejection rollers curves and the second sheet passing path from the axis of the switching lever to the reverse rollers curves;

the ejection section simultaneously performs processing for ejecting a first recording medium to the sheet ejection port by the ejection rollers and processing for switching a transport direction of a second recording medium in the sheet ejection port by the reverse rollers and returning the second recording medium to the first sheet passing path; and the first sheet passing path and the second sheet passing path are formed such that a curving shape of a first moving trajectory of the first recording medium from the axis of the switching lever to the ejection roller along the first sheet passing path is identical to a curving shape of a second moving trajectory of the second recording medium from the axis of the switching lever to the reverse roller along the second sheet passing path, wherein a highest portion of the ejection roller is located above a level of the axis of the switching lever.

16. The image forming apparatus according to claim 15, further comprising:

a fixing section that is provided between the image forming section and the switching lever and that fixes a toner image transferred to the recording medium; and a transport roller placed between the fixing section and the switching lever, wherein the first and second moving trajectories are longer than a moving trajectory of the first recording medium from the fixing section to the transport roller along the first sheet passing path.

17. The image forming apparatus according to claim 15, wherein the first and second moving trajectories having the identical curving shape are sufficiently long to effect the first recording medium transported along the first sheet passing path and the second recording medium transported along the second sheet passing path to have a similar bending tendency to follow substantially parallel trajectories in the sheet ejection port.

* * * * *